US008713887B2

(12) United States Patent
Williams et al.

(10) Patent No.: US 8,713,887 B2
(45) Date of Patent: May 6, 2014

(54) SYSTEM FOR REINFORCING A BUILDING STRUCTURAL COMPONENT

(75) Inventors: Kenneth Richard Williams, Havelock (CA); Robert Drysdale, Ancaster (CA); Cooper Stewart, Pelican Rapids, MN (US)

(73) Assignee: Ideas Without Borders Inc., Havelock, Ontario (CA)

( * ) Notice: Subject to any disclaimer, the term of this patent is extended or adjusted under 35 U.S.C. 154(b) by 405 days.

(21) Appl. No.: 12/009,463

(22) Filed: Jan. 18, 2008

(65) Prior Publication Data

US 2008/0172973 A1 Jul. 24, 2008

(30) Foreign Application Priority Data

Jan. 22, 2007 (CA) ..... 2574722

(51) Int. Cl.
*E04H 12/00* (2006.01)

(52) U.S. Cl.
USPC ..... 52/649.2; 52/309.11; 52/649.4; 52/425; 264/31

(58) Field of Classification Search
USPC ..... 52/852, 853, 856, 857, 426, 309.11, 52/432, 383, 353, 562, 565, 742.14, 52/745.19, 649.2, 649.3, 649.4, 649.5, 52/649.8, 425, 431, 694; 264/31, 35
See application file for complete search history.

(56) References Cited

U.S. PATENT DOCUMENTS

| | | | | | |
|---|---|---|---|---|---|
| 517,921 | A | * | 4/1894 | Goehring | 256/21 |
| 871,699 | A | * | 11/1907 | Horix | 52/856 |
| 1,429,683 | A | * | 9/1922 | Megenity | 52/677 |
| 1,511,334 | A | * | 10/1924 | Havemeyer | 52/649.5 |
| 1,523,811 | A | * | 1/1925 | Lichtenberg et al. | 52/583.1 |
| 1,653,055 | A | * | 12/1927 | Macomber | 52/649.6 |
| 1,708,352 | A | * | 4/1929 | Barton | 52/649.7 |
| 1,738,614 | A | * | 12/1929 | Clement | 52/647 |
| 2,558,946 | A | * | 7/1951 | Bertram | 52/335 |
| 2,844,023 | A | * | 7/1958 | Maiwurm | 52/223.8 |
| 3,245,190 | A | * | 4/1966 | Reiland | 52/649.3 |
| 3,321,884 | A | * | 5/1967 | Hermann | 52/565 |
| 3,407,560 | A | * | 10/1968 | Baumann | 52/645 |
| 3,530,631 | A | * | 9/1970 | Guddal | 52/414 |
| 3,916,592 | A | * | 11/1975 | Morohashi et al. | 52/252 |
| 4,104,842 | A | * | 8/1978 | Rockstead et al. | 52/649.1 |
| 4,119,764 | A | * | 10/1978 | Mizuma et al. | 428/592 |
| 4,236,364 | A | * | 12/1980 | Larsson et al. | 52/383 |
| 4,335,556 | A | * | 6/1982 | Arnold | 52/650.2 |
| 4,336,676 | A | * | 6/1982 | Artzer | 52/309.7 |
| 4,386,489 | A | * | 6/1983 | Sheahan | 52/694 |
| 4,454,695 | A | * | 6/1984 | Person | 52/334 |

(Continued)

FOREIGN PATENT DOCUMENTS

| | | | | |
|---|---|---|---|---|
| CA | 2193630 | | 12/1995 | |
| CA | 2251310 | | 4/2000 | |
| EP | 1469135 | A1 * | 10/2004 | E04C 5/06 |

*Primary Examiner* — Robert Canfield
*Assistant Examiner* — Matthew Gitlin
(74) *Attorney, Agent, or Firm* — Preti Flaherty Beliveau & Pachios LLP

(57) ABSTRACT

The present invention relates to a method and system for reinforcing building structural components. The system includes a rigid continuous stirrup elongated along a longitudinal axis. Portions of the stirrup may be inserted from a lateral direction into cells between webs of the building structural component in an unobstructed fashion. The system also includes at least one reinforcing member situated within a corridor along the length of the stirrup.

14 Claims, 7 Drawing Sheets

(56) References Cited

U.S. PATENT DOCUMENTS

| | | | | | |
|---|---|---|---|---|---|
| RE32,621 | E | * | 3/1988 | Arnold | 52/650.2 |
| 4,748,786 | A | * | 6/1988 | Hannah | 52/694 |
| 4,797,037 | A | * | 1/1989 | Hong | 405/255 |
| 5,025,605 | A | * | 6/1991 | Sekijima et al. | 52/309.16 |
| 5,367,854 | A | * | 11/1994 | Kim | 52/745.13 |
| 5,440,845 | A | * | 8/1995 | Tadros et al. | 52/309.12 |
| 5,501,055 | A | * | 3/1996 | Storch et al. | 52/741.1 |
| 5,802,802 | A | * | 9/1998 | Wegler | 52/693 |
| 5,890,337 | A | * | 4/1999 | Boeshart | 52/426 |
| 6,006,483 | A | * | 12/1999 | Lee | 52/414 |
| 6,135,424 | A | * | 10/2000 | Bracke | 256/59 |
| 6,293,071 | B1 | * | 9/2001 | Konstantinidis | 52/659 |
| 6,345,483 | B1 | * | 2/2002 | Clark | 52/649.1 |
| 6,609,340 | B2 | * | 8/2003 | Moore et al. | 52/309.11 |
| 6,935,081 | B2 | * | 8/2005 | Dunn et al. | 52/426 |
| 7,140,158 | B2 | * | 11/2006 | Steadman | 52/694 |
| 7,162,845 | B2 | * | 1/2007 | Messiqua | 52/404.1 |
| 7,850,399 | B2 | * | 12/2010 | Render | 405/251 |
| 2002/0178676 | A1 | * | 12/2002 | Yost et al. | 52/426 |
| 2004/0074202 | A1 | * | 4/2004 | Barmakian et al. | 52/745.19 |
| 2005/0223669 | A1 | * | 10/2005 | Cymbala et al. | 52/426 |
| 2005/0257485 | A1 | * | 11/2005 | Hahn | 52/716.1 |
| 2006/0137282 | A1 | * | 6/2006 | Anvick et al. | 52/649.1 |
| 2006/0207211 | A1 | * | 9/2006 | Yin | 52/729.1 |
| 2007/0044426 | A1 | * | 3/2007 | Deans | 52/745.19 |

* cited by examiner

SYSTEM FOR REINFORCING A BUILDING STRUCTURAL COMPONENT

CROSS-REFERENCE TO RELATED APPLICATIONS

This application claims priority under 35 U.S.C. §119 to Canadian Patent Application No. 2,574,722 entitled "SYSTEM FOR REINFORCING A BUILDING STRUCTURAL COMPONENT" filed Jan. 22, 2007, the contents of which are hereby incorporated by reference.

FIELD OF INVENTION

The present invention relates to a system for reinforcing a building structural component.

BACKGROUND OF INVENTION

Various systems for reinforcing building structural components have been proposed. Typically, the systems include one or more stirrups and a series of reinforcing bars, which are combined to form a cage-like apparatus. For example, U.S. Pat. No. 6,293,071 (Konstantinidis) discloses a system for reinforcing load bearing building elements. U.S. Pat. No. 6,293,071 describes a system that includes a stirrup with a plurality of windings in combination with reinforcement bars. U.S. Patent Application No. 2005/0257482 (Gallucchio) discloses a system that employs a single continuous stirrup along with a plurality of reinforcement bars. The stirrup may be compressed for ease of transport. Finally, U.S. Patent Application No. 2006/0207211 (Yin) discloses a system with a number of spiral stirrups, each having a series of reinforcing bars.

Systems for reinforcing building structural components may be used with insulated concrete formwork or block masonry. Insulated concrete formwork typically includes webs that join the insulation panels orientated on both sides of the concrete formwork, while block masonry includes webs that join the face shells of the blocks. As such, normally, rigid individual stirrups and reinforcing longitudinal bars must be placed during the construction of the insulated concrete formwork or concrete masonry. A limitation of the prior art structural systems is that the complex combination of stirrup reinforcement and longitudinal reinforcing bars formed into reinforcing cages cannot be used for subsequent construction of insulated concrete formwork or block masonry. A further limitation of the prior art systems is that they employ a complex combination of stirrups and reinforcing bars that cannot be simply inserted into existing insulated concrete formwork or block masonry. Further, because of the complexity of the prior art systems, adjusting the angles, length and height of the cage formed by the stirrup or stirrups and the reinforcing bars, when those components are formed, is time consuming.

SUMMARY OF INVENTION

An object of the invention is to provide an improved structural system for use with existing block masonry or previously assembled insulated concrete formwork. A further object of the invention is to provide an improved structural system by placement of structural components partially or wholly in advance of assembly of insulated concrete formwork or laying of block masonry to form a structural component.

Accordingly, the invention herein comprises a system for reinforcing a building structural component having a plurality of webs. The system has a rigid continuous stirrup elongated along a longitudinal axis and configured into portions. Each portion has two legs joined at an apex by a loop wherein the loops of the portions define at least one corridor disposed above or below the webs of the building structural component when the stirrup is inserted between the webs of the building structural component. The stirrup is insertable between the webs of the structural component in an unobstructed fashion. The system also includes at least one longitudinal reinforcing member situated within the first loops along a corridor and adjacent to the apex of the loops.

A further embodiment of the invention comprises a building structural component in the form of a beam. The beam includes opposing rigid planar members with a plurality of webs spaced in parallel fashion between the planar members. The building structural component further includes a rigid continuous stirrup as described above elongated along a longitudinal axis. The stirrup is positioned with the portions of the stirrup inserted into cells between the webs. The stirrup is also configured so as to extend into at least one corridor along its length. The building structural component also includes at least one longitudinal reinforcing member situated within the corridor.

The invention herein further comprises a method for reinforcing a building structural component having a plurality of webs in spaced planar configuration along the length of the component. The method includes the steps of placing a rigid continuous stirrup as described above on a surface such that the stirrup extends into a lower corridor along its length and an upper corridor along its length. At least one longitudinal reinforcing member is then placed within the lower corridor. The building structural component is then superposed with the stirrup from a lateral direction such that portions of the stirrup are configured in cells between the webs and the stirrup extends into at least one corridor along its length. At least one longitudinal reinforcing member is then placed within the upper corridor. Finally, an adhesive substance is poured into the cells.

The invention also comprises a further method for reinforcing a building structural component having a plurality of webs in spaced planar configuration along the length of the component. The method includes the steps of superposing a rigid continuous stirrup as described above with the building structural component from a lateral direction such that the stirrup extends into at least one corridor along the length of the stirrup and portions of the stirrup are inserted in cells between the webs. At least one longitudinal reinforcing member is then placed within each corridor. Finally, an adhesive substance is poured into the cells.

The invention also comprises a further method for reinforcing a building structural component having a plurality of webs in spaced planar configuration along the length of the component. The method includes the steps of suspending a rigid continuous stirrup as described above on at least one longitudinal reinforcing member above a building structural component. The rigid continuous stirrup is then superposed with the building structural component from a lateral direction such that the stirrup extends into at least one corridor along the length of the stirrup, portions of the stirrup are inserted into cells between the webs and the at least one longitudinal reinforcing member is placed in an upper corridor along the length of the stirrup. A further at least one longitudinal reinforcing member is then placed within a lower corridor. Finally, adhesive is poured into the cells.

Descriptive references herein such as "parallel", "perpendicular", "normal", "straight" or "vertical" are for convenience of description only. It will be appreciated by one skilled in the art that the placement of components may depart moderately from a parallel, perpendicular, normal, straight or vertical configuration.

BRIEF DESCRIPTION OF THE DRAWINGS

In drawings which illustrate by way of example only preferred embodiments of the invention.

DETAILED DESCRIPTION OF THE PREFERRED EMBODIMENTS

Figure 1:
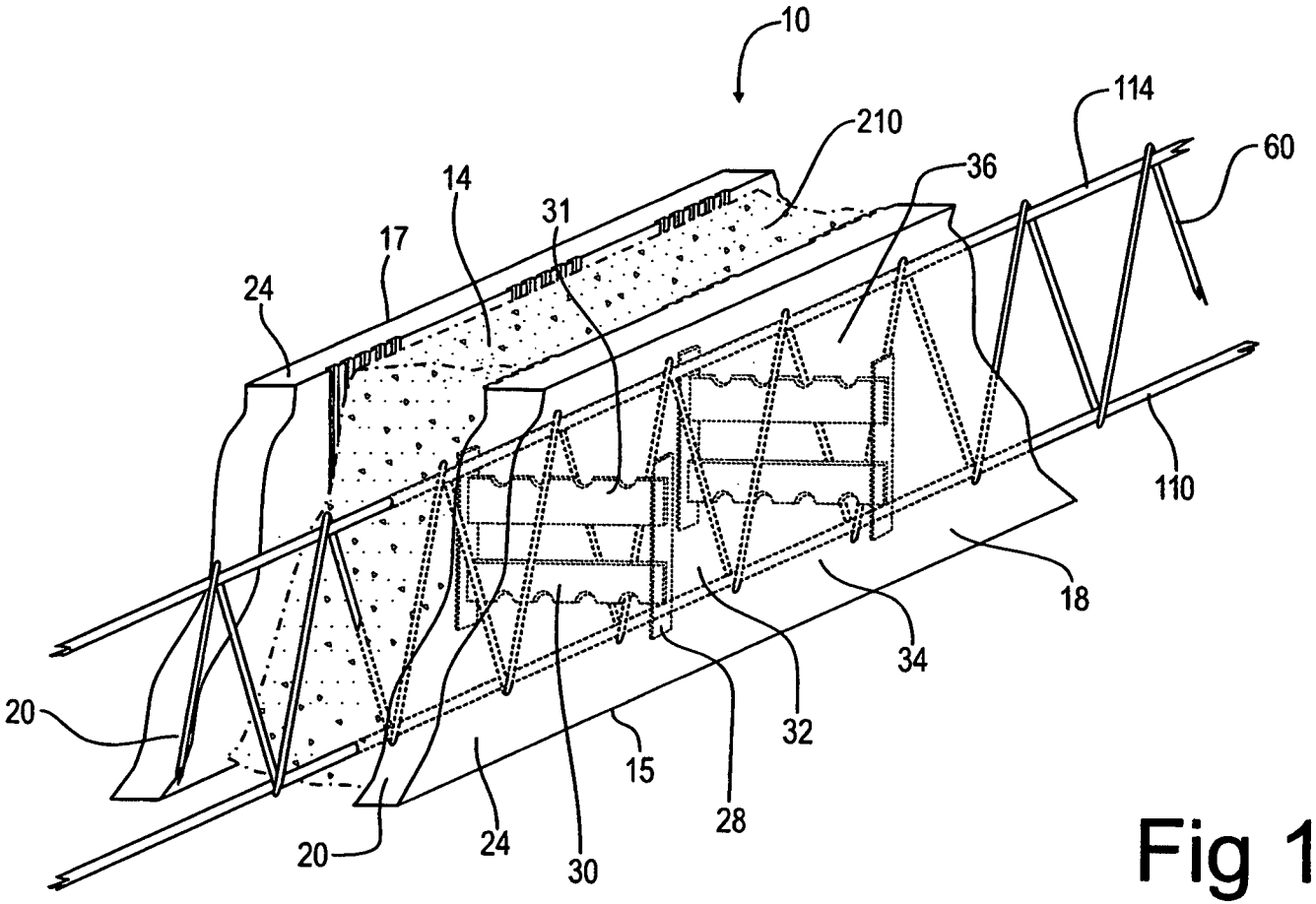
FIG. 1 is a perspective view of an embodiment of the structural reinforcing system used in insulated concrete formwork which has been partially cut away.

A system 10 for reinforcing a building structural component 14 is shown in FIG. 1. The building structural component 14 has a bottom surface 15 and a top surface 17 and opposing rigid planar members 20. The building structural component shown in FIG. 1 is insulated concrete formwork 18. The opposing rigid planar members 20 of the insulated concrete formwork 18 are insulation panels 24.

Webs 28 are also components of insulating concrete formwork 18. Where the building structural component 14 is insulated concrete formwork 18, the webs 28 are metal webs or plastic webs normally found in insulated concrete formwork 18. Such webs 28 have a lower cross portion 30 and an upper cross portion 31. The insulation panels 24 are orientated generally parallel to one another and the webs 28 are orientated generally normal to the insulation panels 24. The webs 28 are embedded in or otherwise attached to the insulation panels 24. The insulation panels 24 and webs 28 define a cell 32. Where there are more than two webs 28 in the insulated concrete formwork 18, there will be a multitude of cells 32. A continuous longitudinal space between the insulation panels 24 and below the lower cross portions 30 of the webs 28 and above the bottom surface 15 forms a lower corridor 34 and a continuous longitudinal space between the insulation panels 24 and above the upper cross portion 31 of the webs 28 and below the top surface 17 forms an upper corridor 36.

Figure 5:
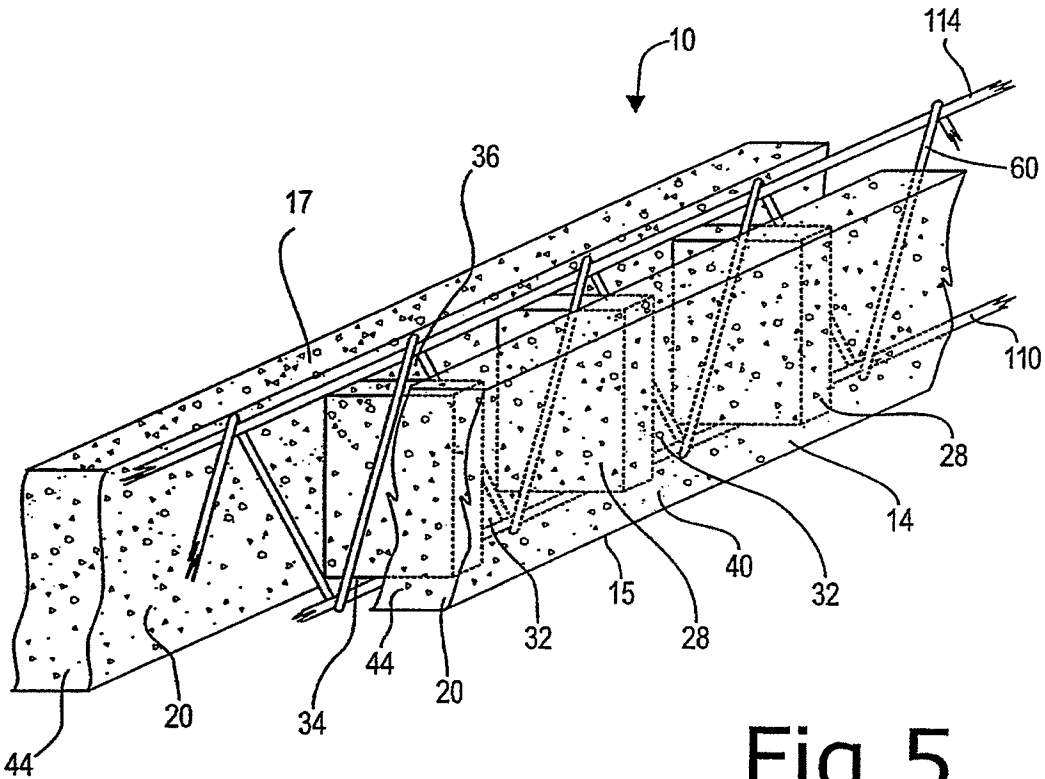
FIG. 5 is a perspective view of an embodiment of the structural reinforcing system as used in block masonry which has been partially cut away.

As seen in FIG. 5, the reinforcing system 10 may also be used with other building structural components 14 having a bottom surface 15 and a top surface 17. The building structural component 14 shown in FIG. 5 is block masonry 40. Such block masonry 40 includes opposing rigid planar members 20. The opposing rigid planar members 20 in block masonry 40 are face shells 44. Face shells 44 are orientated generally parallel to one another. A series of webs 28 joins the face shells 44. The block masonry 40 may be concrete masonry, wood fibre masonry, plastic masonry or any masonry that incorporates compartments. Where the building structural component 14 is block masonry 40, the webs 28 may be concrete, wood fibre, plastic or other suitable material found in masonry. The webs 28 are orientated generally perpendicular to the face shells 44. The face shells 44 and the webs 28 define a series of cells 32. Where there are more than two webs 28, there will be a plurality of cells 32. A continuous longitudinal space between the face shells 44 and below the webs 28 and above the bottom surface 15 forms a lower corridor 34 and a continuous longitudinal space between the face shells 44 and above the webs 28 and below the top surface 17 forms an upper corridor 36.

As seen in each of the figures, the structural reinforcing system 10 incorporates a continuous stirrup 60. The continuous stirrup 60 is elongated along a longitudinal axis. The continuous stirrup 60 is typically made from deformed steel rods or smooth steel rods. Preferably, continuous stirrup 60 is rigid. The continuous stirrup 60 may also be made from materials other than steel including carbon fibres, glass fibres or aramide fibres in the form of rods, rope, cloth or mesh. The continuous stirrup 60 can be supplied in lengths suitable for reinforcing all or part of the length of the structural component 14.

Figure 2:
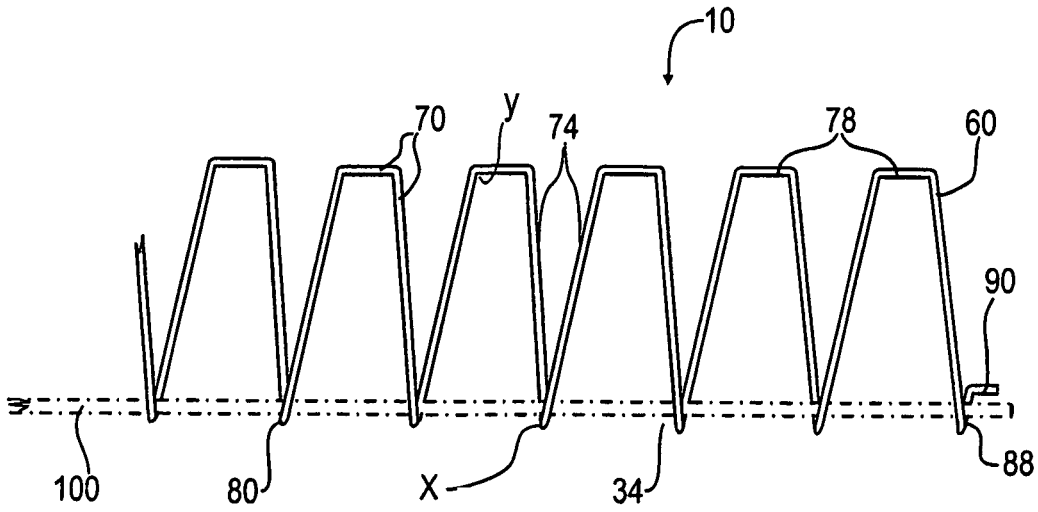
FIG. 2 is a side plane view of an embodiment of the structural reinforcing system incorporating a single reinforcing bar.

As shown in FIG. 2, the continuous stirrup 60 is configured to have a number of portions 70. The portions 70 include a plurality of legs 74 and may include one or more straight portions 78. There are two legs 74 between each of the straight portions 78 and the legs 74 are preferably straight. The continuous stirrup 60 may be formed such that two legs 74 occupy a cell 32. Alternatively, the continuous stirrup may be formed such that more than two legs 74 occupy a cell 32.

The angle x at which the legs 74 meet may also be varied at the time that the continuous stirrup 60 is being formed. The angle y at which the legs 74 meet the straight portions 78 may also be varied when the continuous stirrup 60 is being formed. The continuous stirrup 60 is formed such that the portions 70 of the continuous stirrup 60 are insertable from a lateral direction into the cells 32 of the building structural component 14 between the webs 28 in an unobstructed fashion. Alternatively, the continuous stirrup 60 is formed such that the structural component 14 is positionable over the previously positioned continuous stirrup 60 with the portions 70 of the continuous stirrup 60 fitting into the cells 32 of the structural component 14 in an unobstructed fashion.

As seen in FIG. 2, every second intersection of two legs 74 forms a lower loop 80. The lower loops 80 extend into a lower corridor 34 along the length of the continuous stirrup 60. The continuous stirrup 60 may be anchored at one or both ends of the continuous stirrup 60. In FIG. 2, an end 88 of the continuous stirrup 60 has an anchor 90.

The embodiment of the structural reinforcing system 10 shown in FIG. 2 also incorporates a single reinforcing member 100. The reinforcing member 100 may be an longitudinal reinforcing bar or the like. The reinforcing member 100 is linear and situated within the lower corridor 34. The reinforcing member 100 is generally parallel to the straight portions 78 of the continuous stirrup 60 and is situated proximate to the bottom surface 15 of the building structural component 14. The reinforcing member 100 is generally parallel to the insulation panels 24 of insulated concrete formwork 18 or the face shells 44 of block masonry 40. The straight portions 74 of the continuous stirrup 60 are distal from the bottom surface 15 of the building structural component 14.

Figure 3:
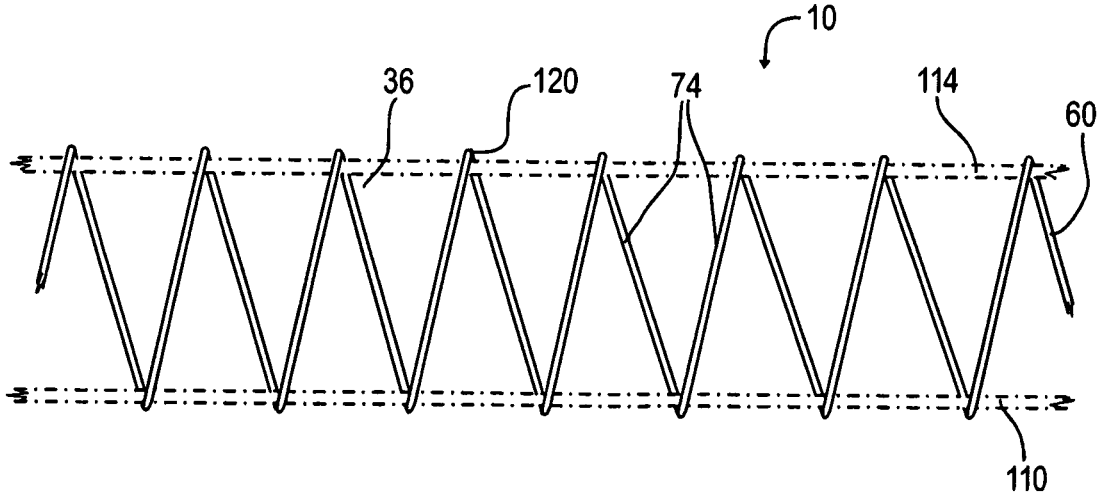
FIG. 3 is a side plane view of an embodiment of the structural reinforcing system incorporating two reinforcing bars.

A further embodiment of the structural reinforcing system 10 is shown in FIG. 3. This embodiment of the structural reinforcing system 10 incorporates two longitudinal reinforcing members. A first reinforcing member 110 is proximate to the bottom surface 15 of the structural component 14 and a second reinforcing member 114 is proximate to a top surface 17 of the structural component 14. The reinforcing members 110 and 114 are linear and generally parallel to one another.

As shown in FIGS. 1 and 5, the first reinforcing member 110 is located in the lower corridor 34 and the second reinforcing member 114 is located in the upper corridor 36.

In the embodiment of the structural reinforcing system 10 shown in FIG. 3, the straight portions 74 of the continuous stirrup 60 have been replaced with a set of upper loops 120 proximate to the top surface 17 of the structural component 14. The upper loops 120 proximate to the top surface 17 of the structural component 14 extend into the upper corridor 36 which receives the second reinforcing member 114. One or more sets of two legs 74 of the continuous stirrup 60 may be inserted from a lateral direction into a cell 32 in an unobstructed fashion. Alternatively, the continuous stirrup 60 is formed such that the structural component 14 is positionable over the previously positioned continuous stirrup 60 with the legs 74 of the continuous stirrup 60 fitting into the cells 32 of the structural component 14 in an unobstructed fashion.

In operation, the continuous stirrup 60 is formed to enclose at least one longitudinal reinforcing member along its longitudinal axis. The dimensions of the building structural component 14 are taken into account when the continuous stirrup 60 is formed. The continuous stirrup 60 is formed such that portions of the continuous stirrup 60 may be inserted from a lateral direction into cells 32 between the webs 28. Alternatively, the continuous stirrup 60 is formed so that it may receive a building structural component 14 that is superposed with the continuous stirrup 60.

A further factor taken into account during the formation of the continuous stirrup 60 is the amount of reinforcement that is required. Where more reinforcement is needed, the continuous stirrup 60 will be configured such that there is a greater length of the continuous stirrup 60 in one or more cells 32. Alternatively, the continuous stirrup 60 may be formed such that portions of the continuous stirrup 60 do not extend through each cell 32, so as to limit the amount of material required to form the continuous stirrup 60.

Figure 4:
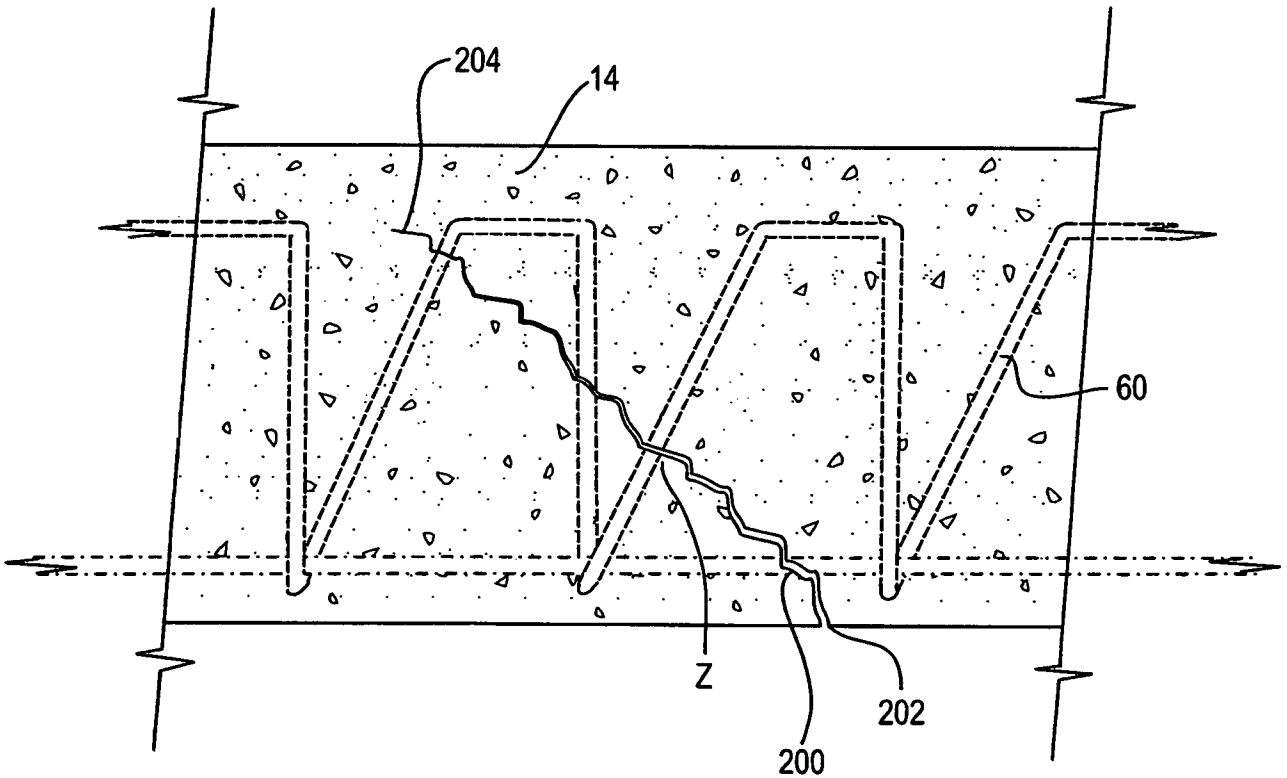
FIG. 4 is a side plane view of an embodiment of the structural reinforcing system within a cracked structural component.

The continuous stirrup 60 may also be formed to more efficiently control growth of any cracks that appear in the building structural component 14. FIG. 4 shows a building structural component 14 with a diagonal crack 200. The diagonal crack 200 starts at a point 202 proximate to an end of the building structural component 14 and ends at a point 204 proximate to the midspan of the structural component 14. A portion of the continuous stirrup 60 will intersect with the plane of the diagonal crack 200 at an angle z. It will be apparent to one skilled in the art that the angle z should approximate 90 degrees to maximize the reinforcement capacities of the structural reinforcing system. In some embodiments, this is achieved using legs 74 of unequal length, as seen in FIG. 4.

Figure 6:
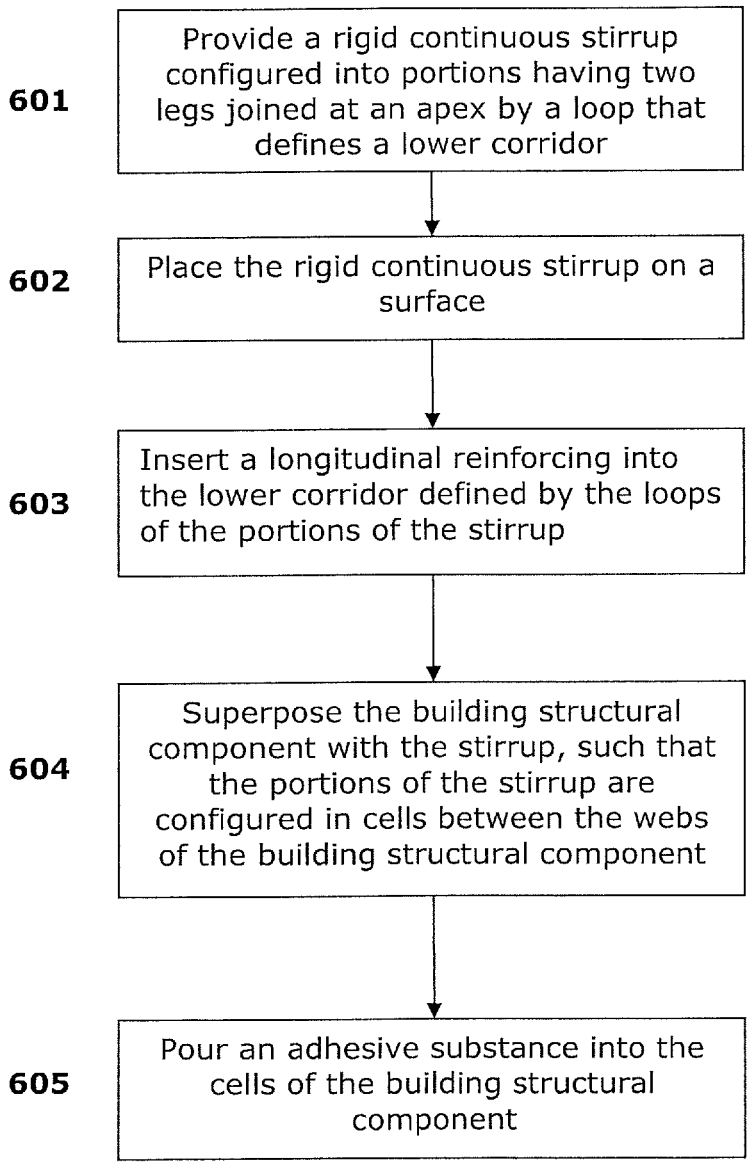
FIGS. 6-8 are flowcharts illustrating processes according to exemplary embodiments of the present disclosure.
Figure 7:
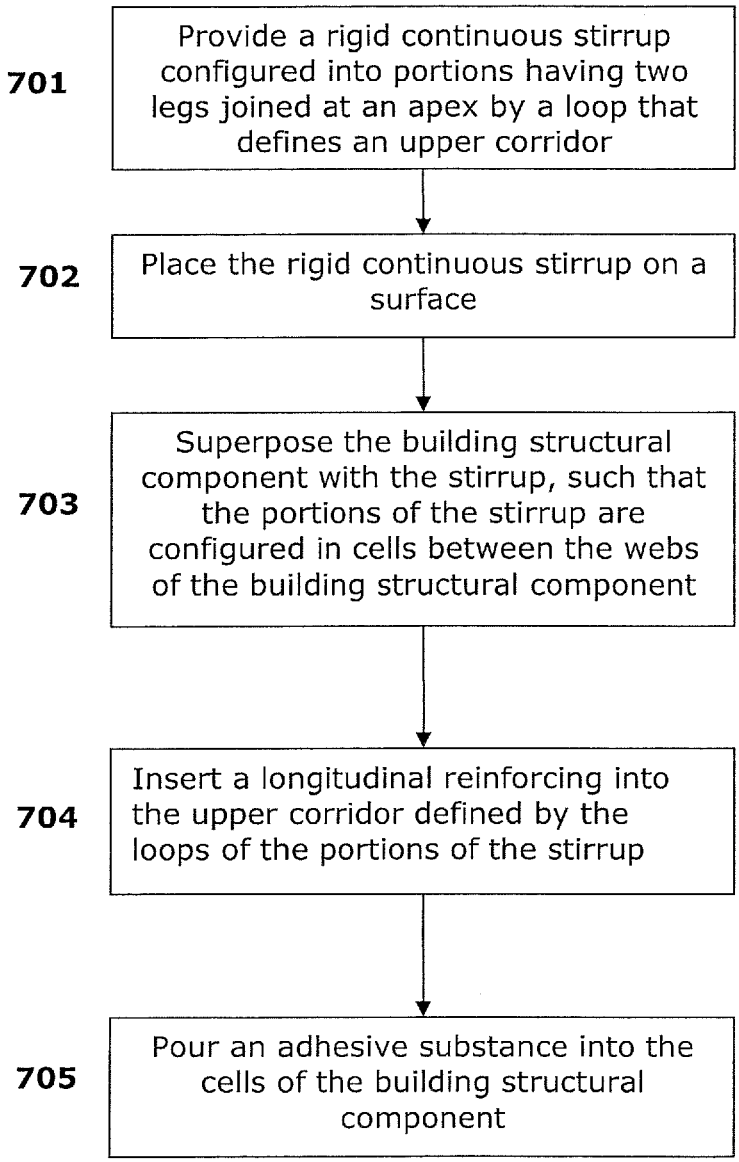

Referring also to FIGS. 6 and 7, processes according to an exemplary embodiment of the present disclosure is illustrated. The stirrup 60 is formed as described above, as illustrated in blocks 601 and 701. Once the continuous stirrup 60 is formed, the continuous stirrup 60 may be placed on a surface, as illustrated in blocks 602 and 702. At least one longitudinal reinforcing member may then be placed in the lower corridor 34, as illustrated in block 603. The building structural component 14 is then superposed with the continuous stirrup 60 from a lateral direction such that portions of the stirrup 60 are configured in cells 32 between the webs 28, as illustrated in blocks 604 and 703. At least one reinforcing member may then be placed within the upper corridor 36, as illustrated in block 704. Finally, as seen in FIG. 1, an adhesive substance 210 is poured over the structural reinforcement system 10, as illustrated in blocks 605 and 705. The adhesive substance 210 is a substance that solidifies once it has dried, such as concrete, grout or the like. Preferably, the adhesive substance 210 fills the cells and all other spaces between the top surface 17 of the structural component 14 and the bottom surface 15 of the structural component 14. Once the adhesive substance 210 has dried, a beam is formed. It will be apparent to one skilled in the art that more than one course of insulated concrete formwork 18 or block masonry 40 may be used for reinforcement.

According to an alternative method, the continuous stirrup 60 is formed as described above. Thereafter, the continuous stirrup 60 is superposed with the structural component 14 from a lateral direction such that portions of the continuous stirrup 60 are inserted in cells 32 or chambers 52 between the webs 28. Thereafter, at least one reinforcing member is placed within each corridor. Finally, an adhesive substance 210 is poured over the structural reinforcing system 10. Preferably, the adhesive substance 210 fills the cells 32 or and any other spaces between the top surface 17 of the structural component 14 and the bottom surface 15 of the structural component 14. Once the adhesive substance 210 has dried, a beam is formed. It will be apparent to one skilled in the art that more than one course of insulated concrete formwork 18 or block masonry 40 may be used for reinforcement.

Figure 8:
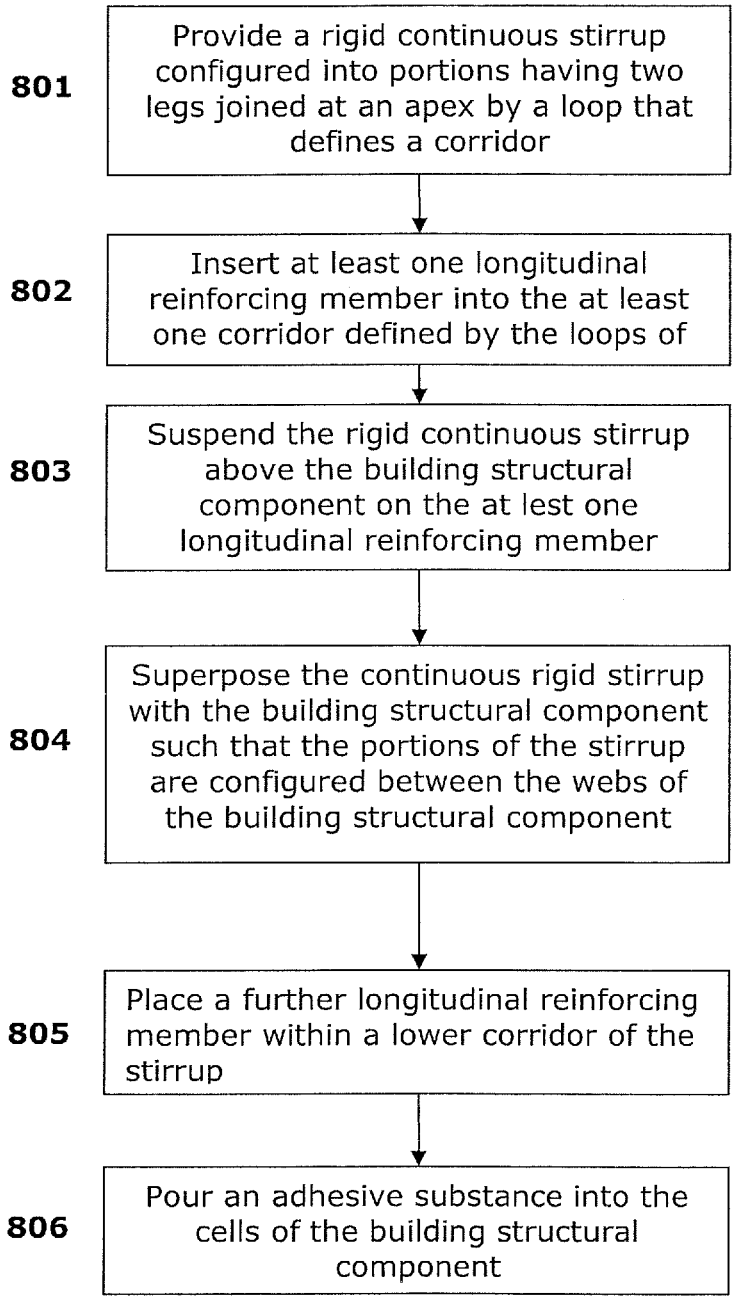

According to a further alternative method, and referring also to FIG. 8, the continuous stirrup 60 is formed as described above, as illustrated in block 801, with at least one longitudinal reinforcing member being placed at least one of the corridors 34, 36, as illustrated in block 802. Thereafter, the continuous stirrup 60 is suspended from at least one reinforcing member above the building structural component 14, as illustrated in block 803. The continuous stirrup 60 is then superposed with the building structural component 14 from a lateral direction such that the continuous stirrup 60 extends into at least one corridor along the length of the continuous stirrup 60. Portions of the continuous stirrup 60 will be inserted into cells 32 between the webs 28 of the building structural component 14, as illustrated in block 804. The at least one reinforcing member will be placed in an upper corridor 36 along the length of the stirrup 60. A further at least one reinforcing member is then placed within a lower corridor 34, as illustrated in block 805. Finally, an adhesive substance 210 is poured over the structural reinforcing system 10, as illustrated in block 806. Preferably, the adhesive substance 210 fills the cells 32 or and any other spaces between the top surface 17 of the structural component 14 and the bottom surface 15 of the structural component 14. Once the adhesive substance 210 has dried, a beam is formed. It will be apparent to one skilled in the art that more than one course of insulated concrete formwork 18 or block masonry 40 may be used for reinforcement.

Numerous modifications may be made to the embodiments described above without departing from the scope of the invention, which is defined by the claims.

We claim:

1. A building structural component in the form of a beam comprising:

opposing rigid planar members including a plurality of webs spaced in parallel fashion between the opposing rigid planar members;

a stirrup comprising a plurality of rigid continuous portions extending along a longitudinal axis, wherein at least one of the portions is inserted in a cell between the webs from above or below in an unobstructed fashion, each portion including a first leg joined to a second leg at an apex by a first loop, the second leg being joined to a first leg of an adjacent portion by a second loop and the first legs of the plurality of portions being substantially coplanar;

wherein the first loops of the plurality of portions define a first corridor configured to receive a first longitudinal reinforcing member, the first corridor being disposed above or below the plurality of webs when the at least one portion is inserted in the cell between the webs;

at least one longitudinal reinforcing member situated within the first corridor; and an adhesive substance between the opposing rigid planar members.

2. The building structural component of claim 1 wherein the opposing rigid planar members are insulation panels.

3. The building structural component of claim 1 wherein the opposing rigid planar members are face shells.

4. The building structural component of claim 1 wherein the webs are situated in planes normal to the opposing rigid planar members.

5. A method for reinforcing a building structural component including a plurality of webs comprising the steps of:

providing a rigid continuous stirrup extending along a longitudinal axis and comprising a plurality of portions, wherein at least one of the portions of the stirrup is insertable between the webs of the building structural component from above or below in an unobstructed fashion, each portion including two legs joined at an apex by a loop, wherein the loops of the portions define at least one lower corridor disposed below the plurality of webs when the stirrup is inserted between the webs of the building structural component;

inserting at least one longitudinal reinforcing member into the at least one lower corridor defined by the loops of the stirrup and adjacent to the apex of the loop;

superposing the building structural component with the stirrup such that the portions of the stirrup are configured in cells between the webs of the building structural component;

pouring an adhesive substance into the cells; and forming the adhesive substance to create the reinforced building structural component.

6. The method of claim 5 wherein the building structural component is insulated concrete formwork.

7. The method of claim 5 wherein the building structural component is block masonry.

8. The method of claim 7 wherein the loops of the portions define at least one upper corridor disposed above the plurality of webs when the stirrup is inserted between the webs of the building structural component, and at least one longitudinal reinforcing member is placed into the upper corridor before the adhesive substance is poured into the cells.

9. The method of claim 5 wherein the adhesive substance is concrete.

10. The method of claim 5 wherein the adhesive substance is grout.

11. The method of claim 5 wherein at least one longitudinal reinforcing member is placed within the upper corridor before the adhesive substance is poured into the cells.

12. A method for reinforcing a building structural component having a plurality of webs comprising the steps of:

providing a rigid continuous stirrup extending along a longitudinal axis and comprising a plurality of portions, wherein at least one of the portions of the stirrup is insertable between the webs of the building structural component from above or below in an unobstructed fashion, each portion having two legs joined at an apex by a loop, wherein the loops of the portions define at least one upper corridor disposed above the plurality of webs when the stirrup is inserted between the webs of the building structural component;

placing the building structural component on a surface;

superposing the stirrup with the building structural component from a lateral direction such that the portions of the stirrup are inserted in cells between the webs of the building structural component;

inserting at least one longitudinal reinforcing member into the at least one upper corridor defined by the loops of the stirrup and adjacent to the apex of the loop;

pouring an adhesive substance into the cells; and forming the adhesive substance to create the reinforced building structural component.

13. A method for reinforcing a building structural component having a plurality of webs comprising the steps of:

providing a rigid continuous stirrup extending along a longitudinal axis and comprising a plurality of portions, wherein at least one of the portions of the stirrup is insertable between the webs of the building structural component from above or below in an unobstructed fashion, each portion having two legs joined at an apex by a loop, wherein the loops of the portions define at least one lower corridor disposed below the plurality of webs when the stirrup is inserted between the webs of the building structural component;

suspending the stirrup above the building structural component, on at least one longitudinal reinforcing member inserted into the at least one corridor defined by the loops of the stirrup and adjacent the apex of the loop;

superposing the stirrup with the building structural component such that the portions of the stirrup are inserted into cells between the webs of the building structural component;

pouring an adhesive substance into the cells; and forming the adhesive substance to create the reinforced building structural component.

14. The method of claim 13 wherein the loops of the portions define at least one corridor disposed below the plurality of webs when the stirrup is inserted between the webs of the building structural component, and at least one longitudinal reinforcing member is placed within the lower corridor before the adhesive substance is poured into the cells.

* * * * *